US009909595B2

(12) United States Patent
Colletti et al.

(10) Patent No.: US 9,909,595 B2
(45) Date of Patent: Mar. 6, 2018

(54) PATCH RING FOR A COMPRESSOR

(71) Applicant: General Electric Company, Schenectady, NY (US)

(72) Inventors: Andrew Joseph Colletti, Greenville, SC (US); Bryan Edward Williams, Greenville, SC (US)

(73) Assignee: General Electric Company, Schenectady, NY (US)

( * ) Notice: Subject to any disclaimer, the term of this patent is extended or adjusted under 35 U.S.C. 154(b) by 296 days.

(21) Appl. No.: 14/804,481

(22) Filed: Jul. 21, 2015

(65) Prior Publication Data

US 2017/0023020 A1 Jan. 26, 2017

(51) Int. Cl.

| | |
|---|---|
| ***F04D 29/64*** | (2006.01) |
| ***F01D 5/06*** | (2006.01) |
| ***F01D 5/00*** | (2006.01) |
| ***F04D 19/02*** | (2006.01) |
| ***F04D 29/32*** | (2006.01) |

(52) U.S. Cl.
CPC ..... *F04D 29/644* (2013.01); *F01D 5/005* (2013.01); *F01D 5/066* (2013.01); *F04D 19/02* (2013.01); *F04D 29/321* (2013.01)

(58) Field of Classification Search
CPC ..... F04D 29/644; F04D 29/321; F01D 5/066
See application file for complete search history.

(56) References Cited

U.S. PATENT DOCUMENTS 2,619,317 A * 11/1952 Traupel ..... F01D 5/066 415/173.7
4,860,418 A * 8/1989 Fleury ..... F01D 5/066 29/418
5,593,273 A 1/1997 Brinkman
6,126,357 A * 10/2000 Alkelin ..... F01D 5/025 403/273

(Continued)

FOREIGN PATENT DOCUMENTS

DE 28 44 746 A1 4/1979
EP 1 785 591 A2 5/2007

(Continued)

OTHER PUBLICATIONS

Extended European Search Report and Opinion issued in connection with corresponding EP Application No. 16178854.2 dated Jan. 13, 2017.

*Primary Examiner* — Richard Edgar
*Assistant Examiner* — John S Hunter
(74) *Attorney, Agent, or Firm* — James W. Pemrick; Ernest G. Cusick; Frank A. Landgraff

(57) ABSTRACT

A compressor has a plurality of stages, and each of the stages includes a wheel. Each wheel is configured to receive one or more rotor blades. The compressor includes a patch ring mounted on a first rotor wheel. The first rotor wheel has a first rabbet machined therein, and the patch ring is located on the first rabbet. A second rotor wheel is located upstream from the first rotor wheel. The second rotor wheel has a second rabbet machined therein, and the second rabbet is configured to be located opposite to the first rabbet. The (Continued)

second rabbet has a second fillet located between axial and radial surfaces of the second rabbet. The patch ring has a radial height greater than or equal to a radial height of the second fillet.

15 Claims, 7 Drawing Sheets

(56) References Cited

U.S. PATENT DOCUMENTS

| | | | | |
|---|---|---|---|---|
| 6,250,883 | B1 * | 6/2001 | Robinson | F01D 5/025 416/198 A |
| 7,427,187 | B2 | 9/2008 | Burdgick et al. | |
| 7,452,188 | B2 * | 11/2008 | Bouchard | F01D 5/066 416/204 R |
| 8,092,168 | B2 | 1/2012 | Vedhagiri et al. | |
| 8,459,943 | B2 * | 6/2013 | Schutte | F01D 5/066 415/199.4 |
| 2011/0299977 | A1 | 12/2011 | Memmer et al. | |
| 2013/0034436 | A1 | 2/2013 | Das et al. | |
| 2016/0362774 | A1 * | 12/2016 | Strock | C23C 4/02 |

FOREIGN PATENT DOCUMENTS

| | | | |
|---|---|---|---|
| JP | S58-57004 | A | 4/1983 |
| JP | H09-189298 | A | 7/1997 |

* cited by examiner

PATCH RING FOR A COMPRESSOR

BACKGROUND OF THE INVENTION

Exemplary embodiments relate to the art of turbomachines and, more particularly, to a patch ring for a compressor and a method for installing the patch ring on a rotor wheel.

Turbomachine compressors create a compressed airflow that is channeled along a flow path and delivered to both a combustor and turbine. The compressor includes a plurality of blades that rotate in close proximity to a casing to create the compressed airflow. Surface defects in the rotor wheels, resulting from manufacturing or service wear, are a risk to wheel integrity and need to be removed. Defects in the rotor wheels must be repaired so they maintain design intent. Currently, patch ring repair segments are installed on the compressor rotor wheels to repair operational or service wear, incorrect machining, or an operational failure that results in surface damage. However, in certain stages the rotor wheels cannot be repaired with a patch ring due to rotor architecture that prevents this type of repair. For example, in certain stages the patch ring could walk off a rabbeted surface, and this could create a machine malfunction during operation.

BRIEF DESCRIPTION OF THE INVENTION

According to one aspect of the invention, a compressor has a plurality of stages, and each of the stages includes a wheel. Each wheel is configured to receive one or more rotor blades. The compressor includes a patch ring mounted on a first rotor wheel. The first rotor wheel has a first rabbet machined therein, and the patch ring is located on the first rabbet. A second rotor wheel is located upstream from the first rotor wheel. The second rotor wheel has a second rabbet machined therein, and the second rabbet is configured to be located substantially opposite to the first rabbet. The second rabbet has a second fillet located between axial and radial surfaces of the second rabbet. The patch ring has a radial height greater than or equal to a radial height of the second fillet.

According to another aspect of the invention, a compressor has a plurality of stages, and each of the stages includes a rotor wheel. Each rotor wheel is configured to receive one or more rotor blades. The compressor includes a patch ring mounted on an upstream side of a first rotor wheel. The first rotor wheel has a first rabbet machined into the upstream side of a first rotor wheel, and the patch ring is located on the first rabbet. A second rotor wheel is located upstream of or from the first rotor wheel. The second rotor wheel has a second rabbet machined into a downstream side of the second rotor wheel, and the second rabbet is configured to be located substantially opposite to the first rabbet. The second rabbet has a second fillet located between axial and radial surfaces of the second rabbet. The patch ring has a radial height greater than a radial height of the second fillet.

According to yet another aspect of the invention, a method is provided of servicing a rotor wheel configured for use with a compressor. The method includes a machining step that machines a first rabbet in a side of a first rotor wheel. An installing step installs a patch ring on the first rabbet. The patch ring has a radial height greater than a radial height of a second fillet formed into a second rabbet in a second rotor wheel.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

One or more specific aspects of the present invention will be described below. In an effort to provide a concise description of these aspects, all features of an actual implementation may not be described in the specification. It should be appreciated that in the development of any such actual implementation, as in any engineering project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of planning, fabrication, and manufacture for those of ordinary skill having the benefit of this disclosure.

When introducing elements of various aspects of the present invention, the articles "a", "an", and "the" are intended to mean that there are one or more of the elements. The terms "comprising," "including," and "having" are intended to be inclusive and mean that there may be additional elements other than the listed elements. Any examples of operating parameters, specific stages, and/or materials are not exclusive of other parameters/materials of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
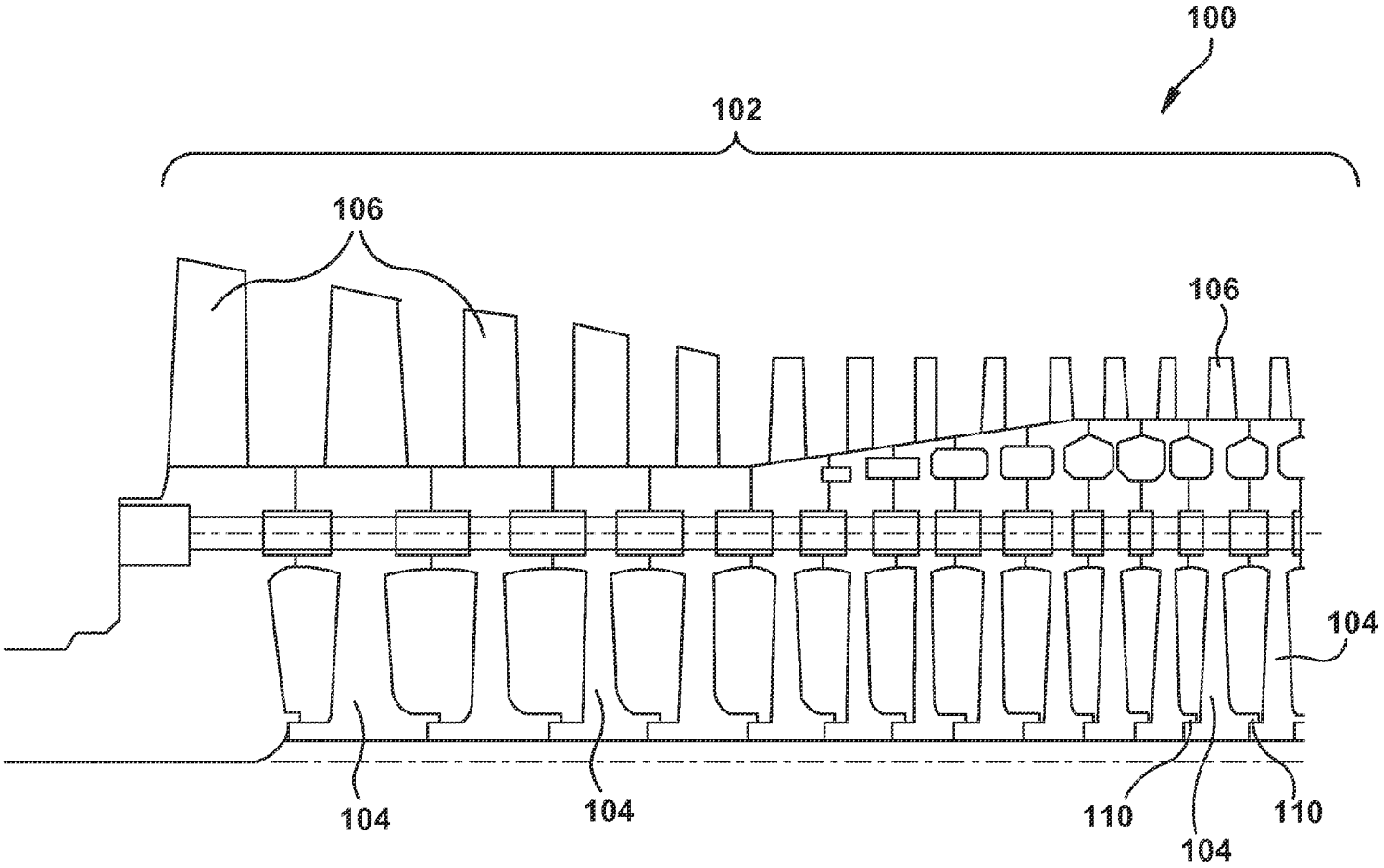
FIG. 1 illustrates a cross-sectional view of a compressor having a plurality of stages.

FIG. 1 illustrates a cross-sectional view of a compressor 100 having a plurality of stages 102. The compressor 100 is often used in conjunction with a gas turbine (not shown), as the compressor compresses intake air which is then fed into a combustor (not shown). The expanding gases from the combustor are then directed to a turbine section of the gas turbine. However, the compressor 100 could be used in any application where a compressed air/gas source is required.

Each stage of the compressor 100 includes a rotor wheel 104 and each wheel 104 is configured to receive and retain a plurality of rotor blades 106. As one example only, the compressor 100 of FIG. 1 may have 17 stages. However, compressors may be configured to have more or less than 17 stages. During disassembly of the rotor for service or repair, each wheel 104 is removed and inspected. Unfortunately, wheels can become damaged during this process, and this damage may be from operational wear and tear or from the actual disassembly process itself. This un-intended contact may gouge or otherwise damage the wheel or a neighboring wheel. Rabbet surfaces 110 are common places for this damage to occur. The rabbet surfaces 110 are typically located at a radially inner or outer portion of the wheel and mate with a corresponding rabbet on a neighboring wheel.

Later compressor stages are particularly difficult or impossible to repair, due to the design and configuration of the wheels. Non-limiting examples of later compressor stage wheels are a stage 12 wheel, stage 13 wheel, stage 14 wheel, stage 15 wheel, stage 16 wheel and stage 17 wheel. The wheel 104 is configured to receive a plurality of rotor blades 106. Wheels 104 may have low, mid and high radius rabbets 110. Low radius rabbets may accept a standard patch ring repair, but these may not be allowed if the wheel has a high velocity oxygen fuel (HVOF) coating. If an HVOF coating, or similar coating, is damaged then the coating must be removed and then reapplied. The later stages may include low, mid and high radius rabbets 110, but because of the size and shape of the rabbets the patch ring repair may not be allowed. A new method for saving damaged compressor wheels would be welcome in the art to reduce waste and to speed up repair time of compressors.

Figure 2:
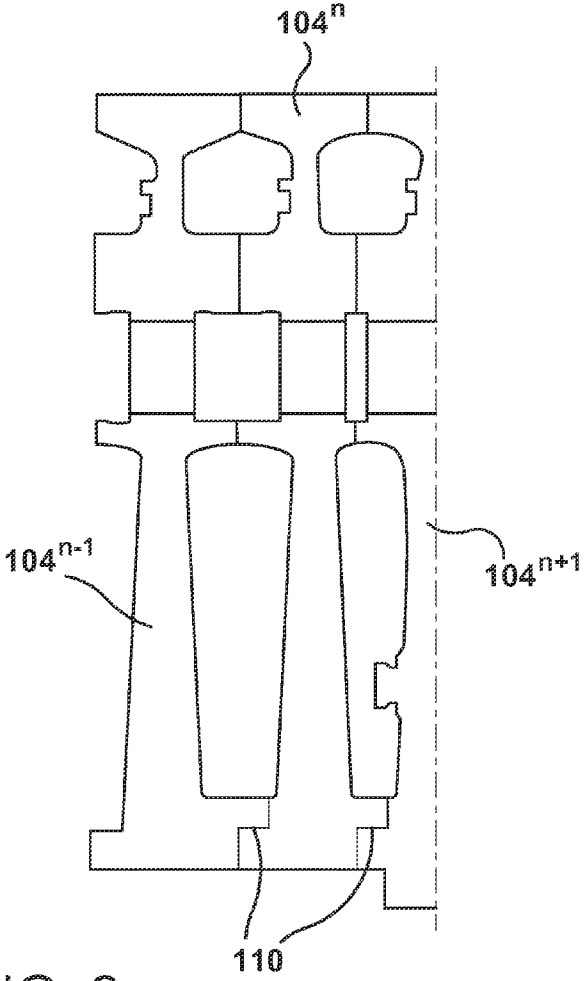
FIG. 2 illustrates an enlarged view of some of the compressor wheels.

FIG. 2 illustrates an enlarged view of compressor wheels 104. Rabbet surfaces 110 can be seen on the radially inner portions of those wheels. Each wheel in all the stages may include rabbets and the location of the rabbets may vary based on the specific configuration of the wheel. As one example only, the downstream rabbet surface for wheel $\mathbf{104}^{n-1}$ and the opposing rabbet surface on the upstream side of the wheel $\mathbf{104}^{n}$ will be located radially outward of the rabbet surfaces 110, which are located between the wheel $\mathbf{104}^{n-1}$ and the wheel $\mathbf{104}^{n}$. There is a similar arrangement between the wheel $\mathbf{104}^{n}$ and wheel $\mathbf{104}^{n+1}$.

Figure 3:
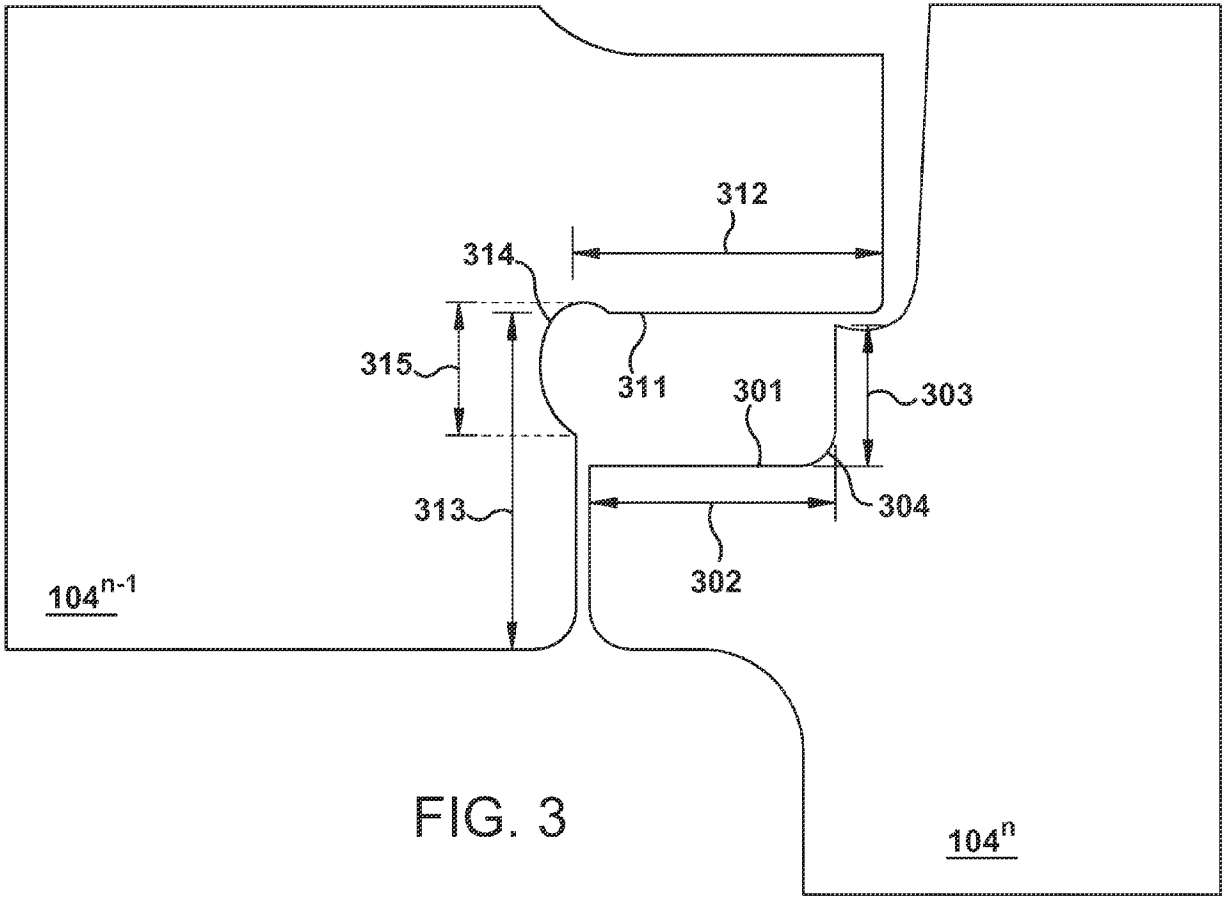
FIG. 3 illustrates an enlarged cross-sectional view of two compressor wheels having rabbets formed therein, according to an aspect of the present invention.

FIG. 3 illustrates an enlarged cross-sectional view of two compressor wheels having rabbets formed therein for repair or service, according to an aspect of the present invention. The rotor wheel $\mathbf{104}^{n-1}$ has a rabbet 301 machined in the upstream side of the wheel. The rabbet 301 has an axial length 302 and a radial height 303. In addition, the rabbet 301 may have a fillet 304 machined into the wheel, and the fillet 304 reduces stress in a localized portion of the wheel. The fillet 304 is a curved surface (or concave junction) that joins and is located between the axial facing and radial facing surfaces of the fillet 301.

The rotor wheel $\mathbf{104}^{n-1}$, which is configured to be located upstream of the rotor wheel $\mathbf{104}^{n}$, has a second rabbet 311. The second rabbet 311 has an axial length 312 and a radial height 313. In addition, the second rabbet 311 may have a second fillet 314 machined into the wheel $\mathbf{104}^{n-1}$, and the second fillet 314 also reduces stress in a localized portion of the wheel $\mathbf{104}^{n-1}$. The second fillet 314 has a radial height 315. The fillet 314 is a curved surface that joins and is located between the axial facing and radial facing surfaces of the second fillet 311. The two rabbets 301 and 311 are configured to be located opposite to each other when the wheels are assembled for operation.

Figure 4:
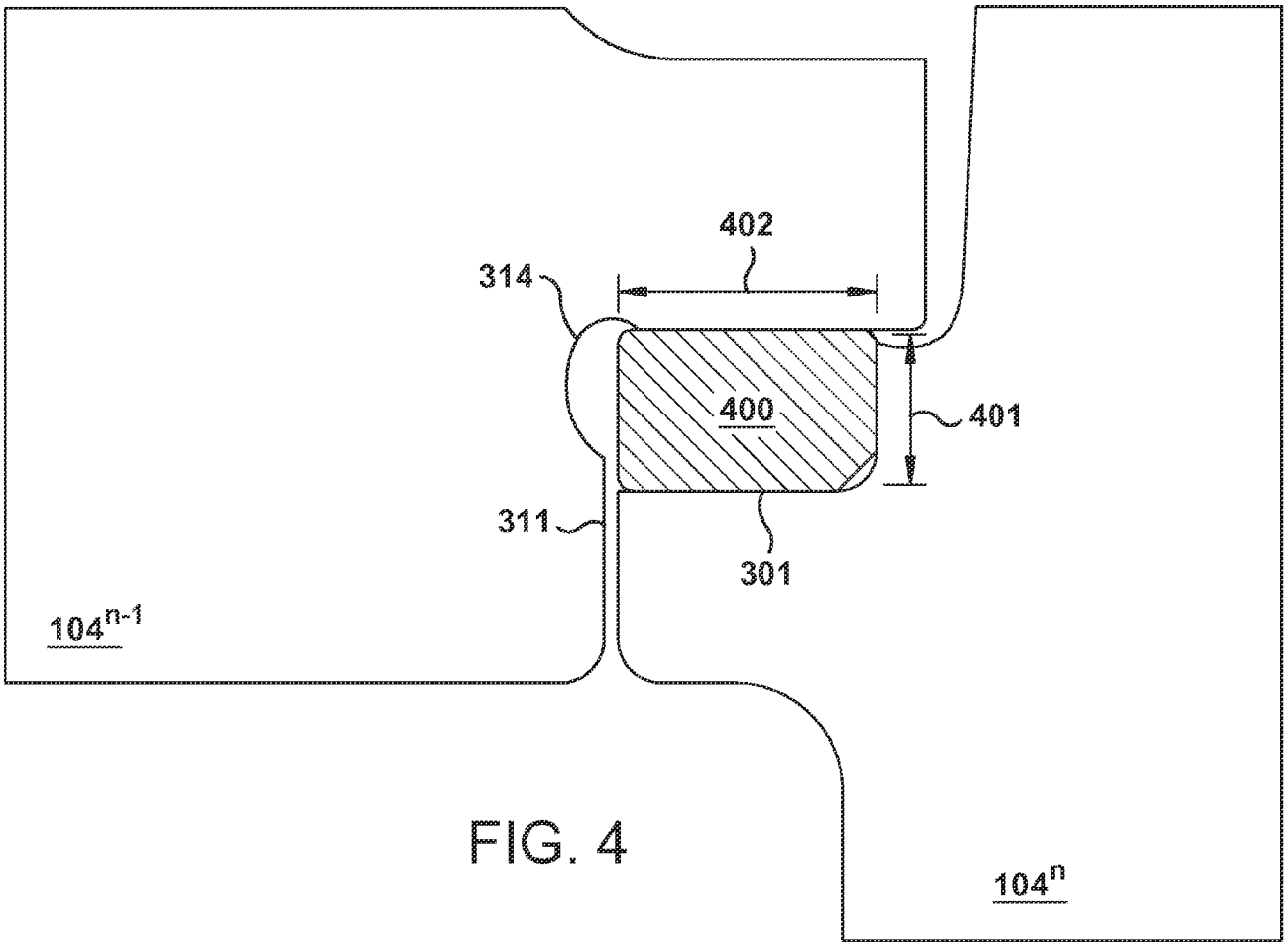
FIG. 4 illustrates an enlarged cross-sectional view of two compressor wheels having rabbets formed therein and a patch ring mounted on one of the rotor wheels, according to an aspect of the present invention.

FIG. 4 illustrates an enlarged cross-sectional view of two compressor wheels having rabbets formed therein and a patch ring mounted on one of the rotor wheels, according to an aspect of the present invention. The patch ring 400 is mounted rotor wheel $\mathbf{104}^{n}$, and is located on the rabbet 301. This is one example only, and it is to be understood that the patch ring 400 could be mounted on any suitable rotor wheel in any desired stage. The patch ring 400 has a radial height 401 that is greater than or equal to the radial height 315 of the $\mathbf{104}^{n-1}$ rotor wheel's fillet 311. The axial length 402 of the patch ring 400 may be substantially equal to (as shown) or greater than the axial length 302 of the first rabbet 301. The patch ring 400 may be formed in one or more pieces that extend circumferentially around the rabbet 301 of the compressor wheel. The patch ring 400 may be formed of any suitable material, such as, stainless steel, nickel alloys, CrMoV alloys, NiCrMoV alloys, or any other suitable alloy.

Figure 5:
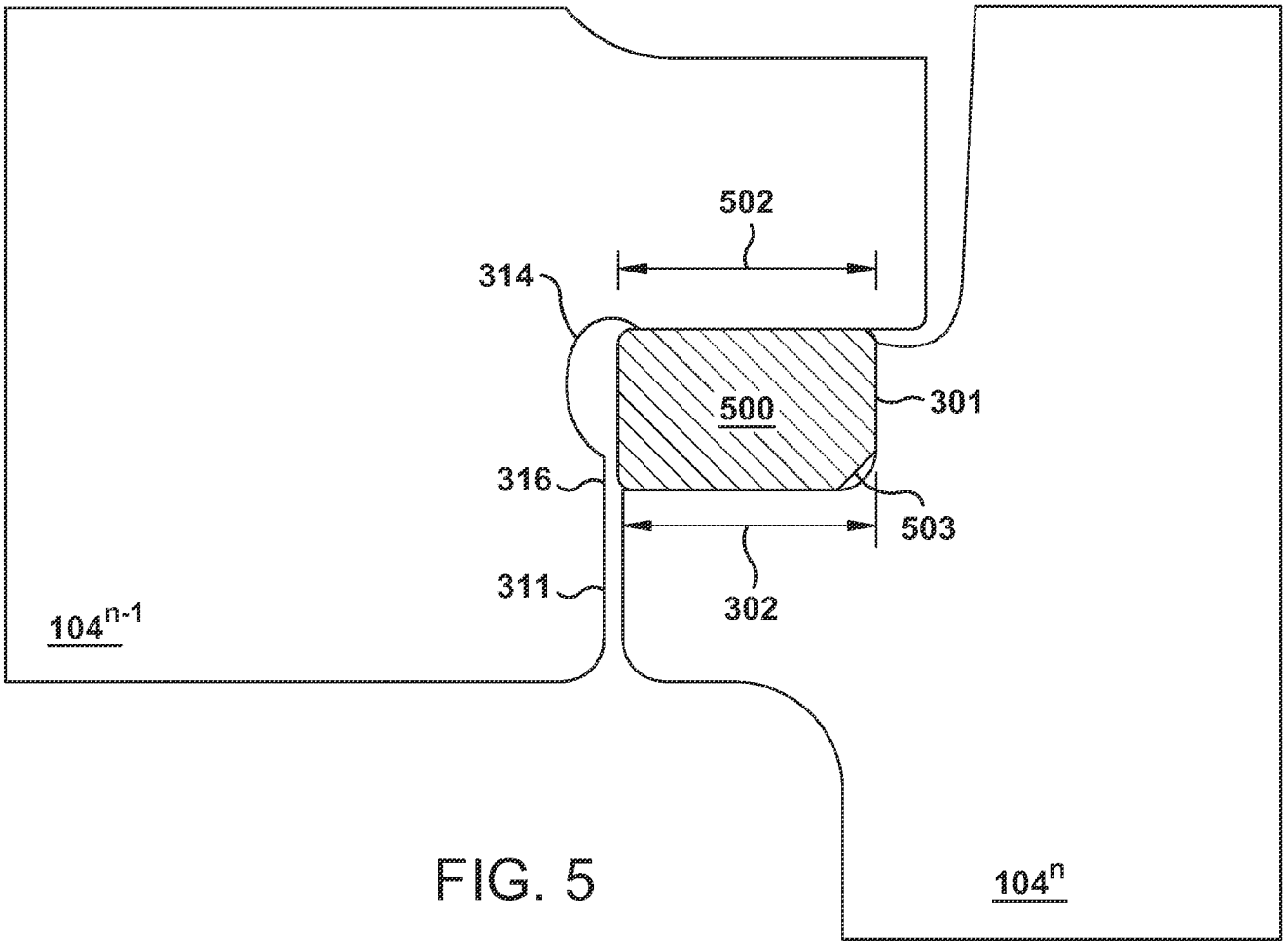
FIG. 5 illustrates an enlarged cross-sectional view of two compressor wheels and a patch ring mounted on one of the rotor wheels, according to an aspect of the present invention.

FIG. 5 illustrates an enlarged cross-sectional view of two compressor wheels and a patch ring mounted on one of the rotor wheels, according to an aspect of the present invention. The patch ring 500 is similar to the patch ring 400 of FIG. 4. However, the axial length 502 of the patch ring 500 is greater than the axial length 302 of the first rabbet 301. The patch ring 500 overhangs the gap between the axial facing surfaces of the two compressor wheels. This configuration will limit axial movement of the patch ring 500, as the patch ring 500 will butt up against axial facing surface 316 of the second rabbet 311 if it moves in an axially upstream direction. The patch ring may also have a tapered or rounded corner 503 located so as to oppose the fillet 304 or the intersection between the axial and radial surfaces of the rabbet 301.

The patch ring may also be staked to further assist in retention thereof. For example, the wheel can be punched (or staked) to locally deform and the deformed material will be accepted by a notch cut into the patch ring. This staking can be done at regular and equally spaced intervals circumferentially around the rotor wheel. As one example only, the wheel could be staked in about eight places, each substantially equidistant from the other (e.g., about 45 degrees apart). However, it is to be understood that the wheel and patch ring could be staked any number of times.

Figure 6:
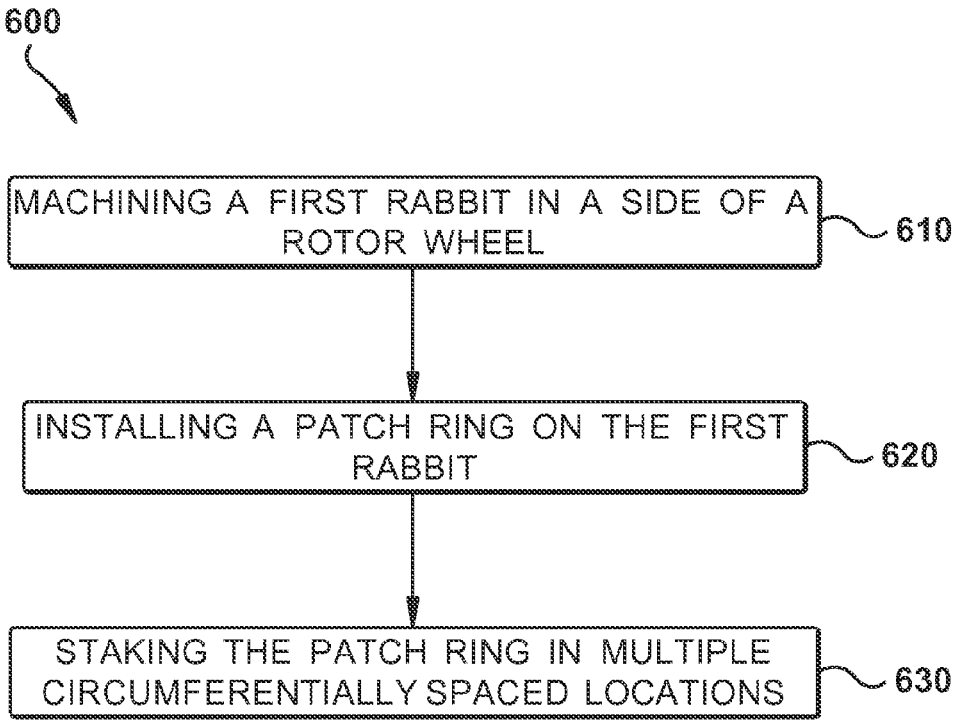
FIG. 6 illustrates a method of servicing a rotor wheel configured for use with a compressor.

FIG. 6 illustrates a method 600 of servicing a rotor wheel configured for use with a compressor. The method includes a step 610 of machining a first rabbet 301 in a side of a first rotor wheel $\mathbf{104}^{n}$. The rabbet may be formed on an upstream side or a downstream side of the first rotor wheel. Step 620 includes installing a patch ring 400, 500 on the first rabbet 301. The patch ring extends circumferentially around the first rotor wheel. The patch ring has a radial height greater than a radial height of a second fillet formed into a second rabbet of a second, but neighboring, rotor wheel $\mathbf{104}^{n-1}$. For example, if the first rabbet was formed on an upstream side of the first rotor wheel $\mathbf{104}^{n}$, then the second rabbet would be formed on the downstream side of the second rotor wheel $\mathbf{104}^{n-1}$. Conversely, if the first rabbet was formed on a downstream side of the first rotor wheel, then the second rabbet would be formed on the upstream side of the second rotor wheel. The patch ring may also have an axial length greater than or substantially equal to the axial length of the first rabbet. It is to be understood that any suitable wheels and stages can incorporate the patch ring according to aspects of the present invention. However, the first and second rotor wheels do need to be in neighboring/adjacent stages so that the two rabbets oppose each other. In step 630, the wheel and/or patch ring may be staked in multiple and circumferentially spaced locations.

Figure 7:
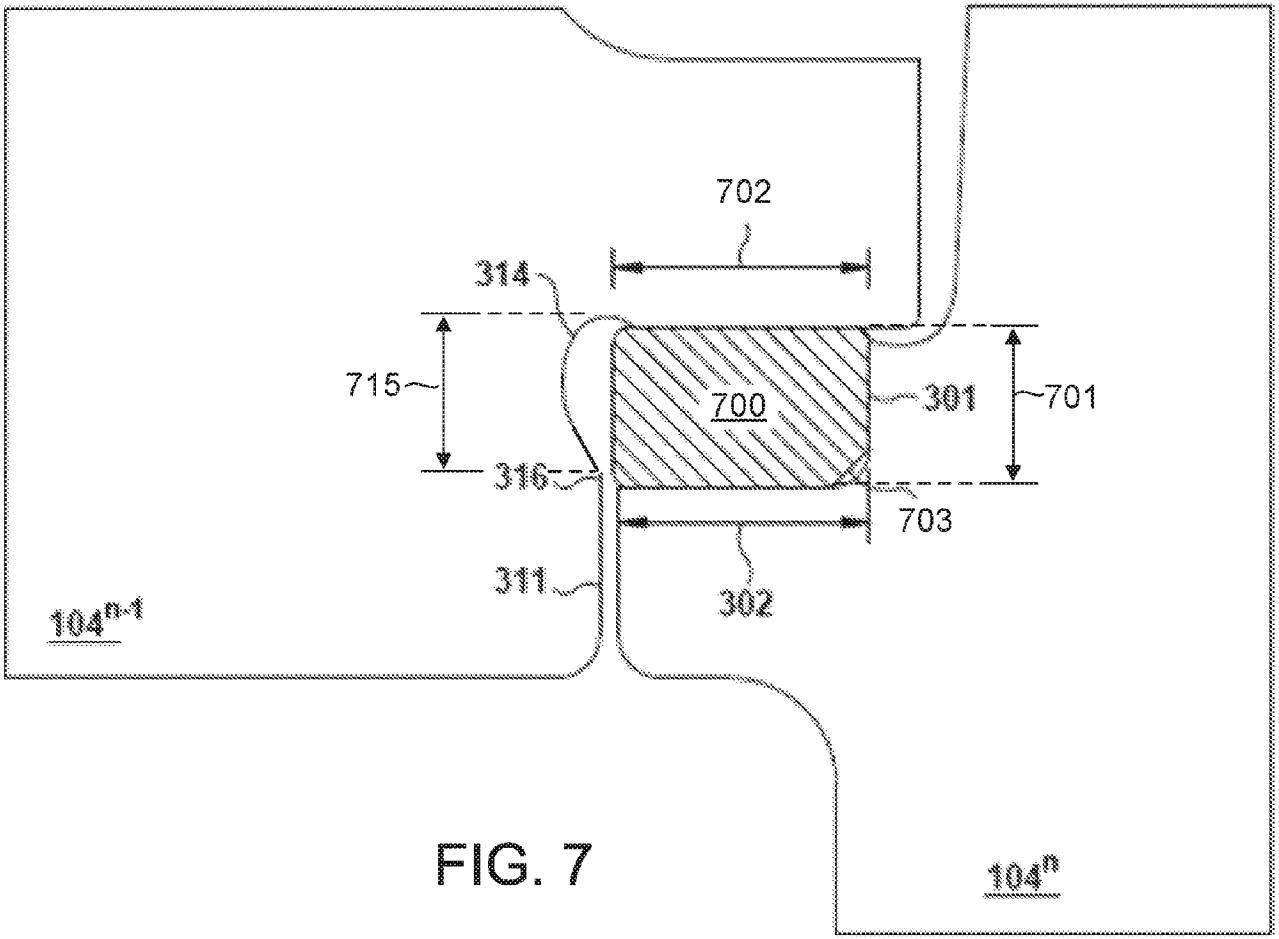
FIG. 7 illustrates an enlarged cross-sectional view of two compressor wheels and a patch ring mounted on one of the rotor wheels, according to an aspect of the present invention.

FIG. 7 illustrates an enlarged cross-sectional view of two compressor wheels and a patch ring mounted on one of the rotor wheels, according to an aspect of the present invention. The patch ring 700 is similar to the patch ring 400 of FIG. 4. However, the axial length 702 of the patch ring 700 is greater than the axial length 302 of the first rabbet 301. The patch ring 700 overhangs the gap between the axial facing surfaces of the two compressor wheels. This configuration will limit axial movement of the patch ring 700, as the patch ring 700 will butt up against axial facing surface 316 of the second rabbet 311 if it moves in an axially upstream direction. The patch ring may also have a tapered or rounded corner 703 located so as to oppose the fillet 304 or the intersection between the axial and radial surfaces of the rabbet 301. The patch ring 700 has a radial height 701 equal to a radial height 715 of the second fillet 314.

At this point it should be understood that the exemplary embodiments provide a system for re-surfacing an inner surface of a turbomachine component. In addition, it should be understood that while shown and described in connection with a compressor, the patch rings in accordance with the exemplary embodiments can also be employed in other turbomachine components such as turbines.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor having a plurality of stages, each of the stages comprising a wheel and each wheel is configured to receive one or more rotor blades, the compressor comprising:

a patch ring mounted on a first rotor wheel, the first rotor wheel having a first rabbet machined therein, the patch ring located on the first rabbet, the patch ring having an axial length greater than an axial length of the first rabbet;

a second rotor wheel located upstream from the first rotor wheel, the second rotor wheel having a second rabbet machined therein, the second rabbet configured to be located opposite to the first rabbet, the second rabbet having a second fillet located between axial and radial surfaces of the second rabbet; and wherein the patch ring has a radial height greater than or equal to a radial height of the second fillet.

2. The compressor of claim 1, the radial height of the patch ring being greater than the radial height of the second fillet.

3. The compressor of claim 1, the first rabbet having a first fillet machined therein, and wherein the first fillet reduces stress in a localized portion of the first rotor wheel.

4. The compressor of claim 3, the first fillet comprised of a curved surface between axial and radial surfaces of the first rabbet.

5. The compressor of claim 1, the patch ring having a tapered or rounded corner located to oppose an intersection between axial and radial surfaces of the first rabbet.

6. The compressor of claim 1, the second fillet comprised of a curved surface between axial and radial surfaces of the second rabbet, and wherein the second fillet reduces stress in a localized portion of the second rotor wheel.

7. The compressor of claim 1, the first rabbet having a first fillet machined therein, and wherein the first fillet reduces stress in a localized portion of the first rotor wheel.

8. The compressor of claim 7, the first fillet comprised of a curved surface between axial and radial surfaces of the first rabbet.

9. A compressor having a plurality of stages, each of the stages comprising a rotor wheel and each rotor wheel is configured to receive one or more rotor blades, the compressor comprising:

a patch ring mounted on an upstream side of a first rotor wheel, the first rotor wheel having a first rabbet machined into the upstream side of a first rotor wheel, the patch ring located on the first rabbet, the patch ring having an axial length greater than an axial length of the first rabbet;

a second rotor wheel located upstream of the first rotor wheel, the second rotor wheel having a second rabbet machined into a downstream side of the second rotor wheel, the second rabbet configured to be located opposite to the first rabbet, the second rabbet having a second fillet located between axial and radial surfaces of the second rabbet; and wherein the patch ring has a radial height greater than a radial height of the second fillet.

10. The compressor of claim 9, the patch ring having a tapered or rounded corner located to oppose an intersection between axial and radial surfaces of the first rabbet.

11. The compressor of claim 10, the second fillet comprised of a curved surface between axial and radial surfaces of the second rabbet, and wherein the second fillet reduces stress in a localized portion of the second rotor wheel.

12. A compressor having a plurality of stages, each of the stages comprising a wheel and each wheel is configured to receive one or more rotor blades, the compressor comprising:

a patch ring mounted on a first rotor wheel, the first rotor wheel having a first rabbet machined therein, the patch ring located on the first rabbet;

a second rotor wheel located upstream from the first rotor wheel, the second rotor wheel having a second rabbet machined therein, the second rabbet configured to be located opposite to the first rabbet, the second rabbet having a second fillet located between axial and radial surfaces of the second rabbet; and wherein the patch ring has a radial height equal to a radial height of the second fillet.

13. The compressor of claim 12, the patch ring having an axial length greater than an axial length of the first rabbet.

14. The compressor of claim 12, the patch ring having a tapered or rounded corner located to oppose an intersection between axial and radial surfaces of the first rabbet.

15. The compressor of claim 12, the second fillet comprised of a curved surface between axial and radial surfaces of the second rabbet, and wherein the second fillet reduces stress in a localized portion of the second rotor wheel.

* * * * *